United States Patent [19]

Ward

[11] 4,332,315

[45] Jun. 1, 1982

[54] COIN OPERATED LOCK MECHANISM

[76] Inventor: Joseph O. Ward, 4835 Galendo St., Woodland Hills, Calif. 91364

[21] Appl. No.: 159,961

[22] Filed: Jun. 16, 1980

[51] Int. Cl.[3] ..... G07F 1/04

[52] U.S. Cl. ..... 194/1 G; 194/65; 194/DIG. 2

[58] Field of Search ..... 194/1 R, 1 G, 59, 65, 194/92, DIG. 2, DIG. 20

[56] References Cited

U.S. PATENT DOCUMENTS

| | | | |
|---|---|---|---|
| 3,228,506 | 1/1966 | Stackhouse . | |
| 3,229,797 | 1/1966 | Stackhouse | 194/1 G |
| 3,394,790 | 7/1966 | Braun . | |
| 3,599,770 | 8/1971 | Stackhouse et al. . | |
| 3,613,855 | 10/1971 | Stackhouse et al. . | |
| 3,938,640 | 2/1976 | Stackhouse et al. . | |
| 4,131,191 | 12/1978 | Barth et al. . | |
| 4,153,150 | 5/1979 | Barth et al. . | |

*Primary Examiner*—Joseph J. Rolla
*Attorney, Agent, or Firm*—John J. Casparro

[57] ABSTRACT

A coin operated lock mechanism used for securing a cabinet or similarly lockable door, highlighted by a coin chamber and coin follower assemblage adapted to adjustably accommodate for different denominations of coins or tokens, as well as for differing pluralities of each denomination, and to prevent coins or tokens of other than the given denomination from effecting the operation of the lock mechanism.

9 Claims, 6 Drawing Figures

COIN OPERATED LOCK MECHANISM

BACKGROUND OF THE INVENTION

This invention relates to a coin operated lock mechanism of the type generally disclosed in U.S. Pat. Nos. 3,228,506; 3,599,770; 3,613,855; 3,938,640; 4,131,191 and 4,153,150, wherein the locker key may be removed from the lock when the cabinet door is in the closed position, the proper coins have been deposited in the lock and the key turned to extend the locking mechanism.

In U.S. Pat. Nos. 3,228,506 and 3,599,770, the locks were designed to be adjustable to accomodate coins of differing denominations, but the adjustment mechanisms are limited to single coin operation.

The present invention features a lock mechanism of ruggedized all metal construction, simply and easily adapted to accomodate the designated quantity and size of coins specified for operation. The design concept employed in the present invention consists of only three moving parts and eliminates the need for fine tuning of periodic maintenance of such elemental features, as pawls, levers, gauging arms/pins and intercepting fingers, as required in the operation of coin operated locks of the general type disclosed in the above mentioned patents.

Locks of the type described in U.S. Pat. Nos. 3,613,855; 4,131,191 and 4,153,150 have all been designed to permit two coin operation by coins of different denominations, and as such are not operational for either a greater or lesser number of coins. In addition, the lock mechanism described in U.S. Pat. No. 3,613,855 is not readily adjustable to allow operation by coins of differing denominations. In U.S. Pat. No. 3,938,640, the lock may be adjusted to accomodate for different coin denominations, as well as for the varying numbers of coins of each denomination. However, the construction of the selector mechanism of this lock is such that it may become inoperative when a mixed denomination group of coins are inserted into the unit.

The basic lock mechanism disclosed in U.S. Pat. No. 3,394,790, used for locking a U-rod and subsequently for securing sporting equipment such as skis, has been applied in principle to coin and key operated locks adapted for use in locker cabinets. In this application, as in the configuration cited in the above-mentioned patent, the design of the lock mechanism is adapted for operation by a single coin of fixed denomination and as such, does not provide the versatility of the present invention, which permits the lock mechanism to be operated by a varying number of coins of differing denominations. Another limitation of this prior invention is that its expanded size prohibits installation anywhere but in the door of the locker, exposing the coin collection receiver to petty theft and vandalism.

SUMMARY OF THE INVENTION

The present invention is directed towards a coin operated lock mechanism, whereby the locking mechanism may be easily adapted to accomodate both different coin denominations and also differing pluralities of each denomination of coin.

The present lock construction employs a coin chamber and coin follower assemblage which provides a simple, accurate, reliable means of adjusting for the number and size of coins required for locker operation. Three adjustments on the assemblage are all that are necessary to establish the quantity of coins, from one to three, and the denomination of coin, in U.S. currency from one dime to one half-dollar and all diameters there-in-between, desired to effect operation. The coin chamber, which receives the designated number and denomination of coins deposited through the coin slot, is equipped with two calibrated adjusters; the first is a coded shim set which is used to separate the coin support walls of the coin chamber for establishing the overall thickness of coins, and the second is a depth roller which may be accurately positioned, by use of index marks, along the length of the coin chamber to provide for the basic diameter of the coin. The coin follower is a heavily weighted member which is translationally adjustable along its length to allow release of the lock mechanism only after the proper number and denomination of coins have been received in the coin chamber. As with the design of the depth roller, index marks on the coin follower provide an accurate, repeatable method of adjustment.

An inoperable lock, as a result of coin jamming, has been carefully considered, and the present invention provides the means for preventing such an occurence. To exclude coins larger than those designated for locker use, there is provided a coin slot guide. The guide, which is an adjustable plate used to limit the length of the coin slot, accurately gauges the slot opening by means of scribed index marks on the guide. Conversely, coins which are smaller in diameter than the given denomination coin are not retained by the depth roller in the coin chamber and are allowed to discharge harmlessly through the coin chamber. Further, storage of the deposited coins in the coin chamber, immediately forward of the coin slot, prevents the inclusion of additional coins once the proper number and denomination of coins have been received in the coin chamber of the lock.

Still another feature of the present invention, incorporated to prevent intentional or unintentional jamming of the lock, is a narrow coin passage configured in the coin follower through which the deposited coins must pass. The reduced width of this opening prevents a coin from being deposited into the coin slot on the wrong, or down chamber, side of previously inserted coins. Also, the action of the locking mechanism to close off the coin slot under a slight rotation of the patron key, with or without coins deposited in the coin chamber, prevents the insertion of any thin object through the coin slot to manipulate, or otherwise override, the lock mechanism.

DRAWINGS

The present invention will be described in the detailed description which follows, taken in conjunction with the accompanying drawings, wherein.

DETAILED DESCRIPTION

Figure 1:
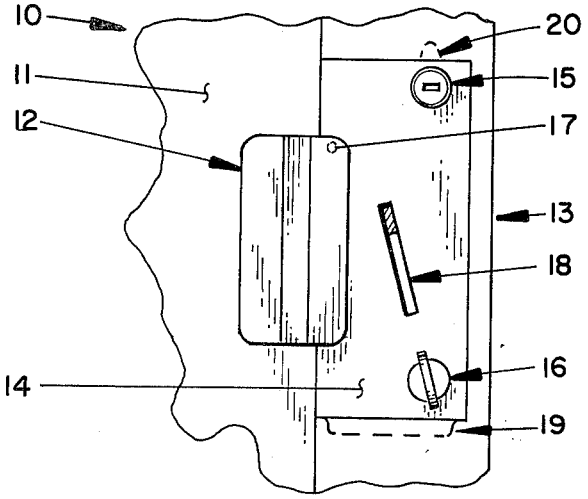
FIG. 1 is a front elevational view of a coin operated lock mechanism fabricated in accordance with the present invention, with portion of a lockable compartment showing.

Referring to FIG. 1, 10 indicates a lockable compartment, for example a coin operated checking locker, and 11 depicts a compartment door to which is affixed a door handle 12. Employed in lockable compartment 10, at a location adjacent to door 11, is a locking mechanism 13, which enables door 11 to be locked when it is located in the closed position. Lock mechanism 13 includes a front face plate 14, through which extends a custodian lock 15, a patron lock 16 and a lock release 17. A rectangular opening in front plate 14 defines a coin slot 18, which has been sized to control the denominations of coin which may be deposited in the lock.

Figure 2:
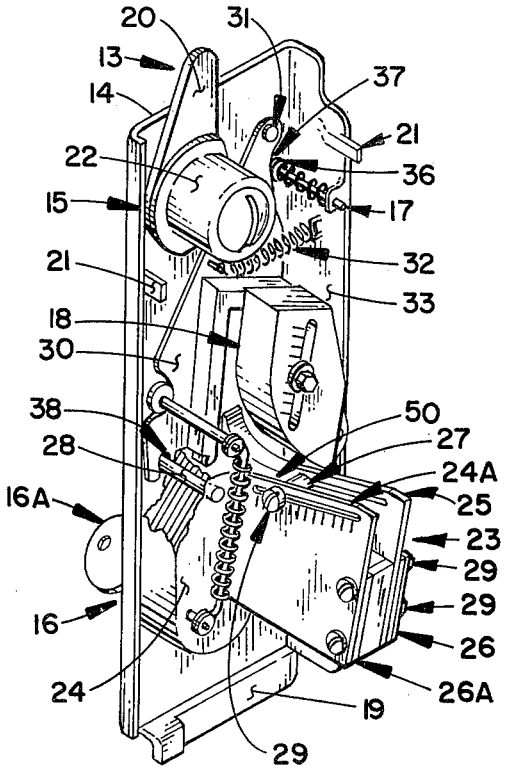
FIG. 2 is a perspective view of the lock mechanism employed in the present invention, with no coins in the lock and the lock shown in the fully unlocked position.

Referring now to FIG. 2, front plate 14 of lock mechanism 13 is disposed over and fills an opening in compartment 10, not shown. Lock mechanism 13 is removably secured within this opening by operation of a front plate bottom lip 19, by a pair of front plate side lips 21 and a custodian lock lip 20, which is an integral part of shell 22 of custodian lock 15. Shell 22, and consequently, lock lip 20, are rotatable by means of a removable custodian lock key, not shown, from the position shown herein to a point approximately 90° therefrom, permitting the entire lock mechanism 13, to be removed from compartment 10.

Again referring to FIG. 2, patron lock 16, which includes a square extension housing or plug, not shown, is non-removably carried by front plate 14. A coin chamber 23 is rotatably supported by the extension housing, whereas a lock cylinder, not shown, is rotatably supported within the extension housing, such arrangement permitting rotation of coin chamber 23, under the influenced rotation of patron key 16A. Coin chamber 23 is formed by a support base and wall 24, which is rigidly affixed to the extension housing of patron lock 16, a coin support wall 25, a coded shim set 26, a depth roller 27, a drive pin 28 and a set of mounting hardware 29 used to affix coin support wall 25 to support base 24 and to secure elements of shim set 26 and depth roller 27 thereinbetween. In this configuration, coin chamber 23 is positioned with its inlet end in communication with coin slot 18 and discharge end, when referring to the passage of coins of smaller than designated diameter, in communication with a coin collection box, not shown. In the fully unlocked position, the coin support walls of coin chamber 23, are aligned with the extending sides of coin slot 18, and depth roller 27 positioned immediately forward of coin slot 18. Front plate 14 further serves to rotationally support a locking latch 30, at pivot pin 31, for orientation between the disengaged or unlocked position shown here in FIG. 2 and the engaged or locked position depicted in FIG. 6. Now referring to FIG. 6, a latch tension spring 32, connected between a side wall 33 of front plate 14 and locking latch 30, provides full and positive extension of locking latch 30 in the locked position. An elongated slot 34 in side wall 33 of front plate 14, permits the extension of locking latch 30 in the engaged position. A coin slot guide 35 movably fixed to locking latch 30, which pivots immediately in front of coin slot 18 and is apertured to define an opening coincident with coin slot 18 in the unlocked position, serves to selectively control the maximum diameter of coins which may be inserted through coin slot 18.

Referring once again to FIG. 2, a circular stop 36, which is rigidly affixed to the shaft of lock release 17, is spring loaded and cradled within an upper opening recess 37 of locking latch 30. Drive pin 28, which protrudes from the underside of support base 24 of coin chamber 23, is nested within a bottom opening recess 38 of locking latch 30. With compartment door 11, not shown, in any position other than fully closed, with or without the proper denomination of coins in coin chamber 23, locking latch 30 is restricted from movement as a result of the blockage created by circular stop 36, and patron key 16A is thereby constrained against rotation from its unlocked position. However, when compartment door 11 is fully closed, the spring restraining lock release 17 is depressed to remove circular stop 36 from within side opening recess 37 of locking latch 30 as denoted in FIG. 3, thereby freeing the patron lock 16 for rotation, under the influence of patron key 16A.

A forward edge 41 of support base 24 of coin chamber 23 in contact with the inner surface of opposite side wall 40 of front plate 14 establishes the proper orientation of coin chamber 23 with relation to coin slot 18, in the unlocked position. A compression spring and guide 42, extending between a spring support base 24 of coin chamber 23, provides positive placement of coin chamber 23, with the unit in either fully unlocked, counterclockwise, or fully locked, clockwise, position.

Figure 3:
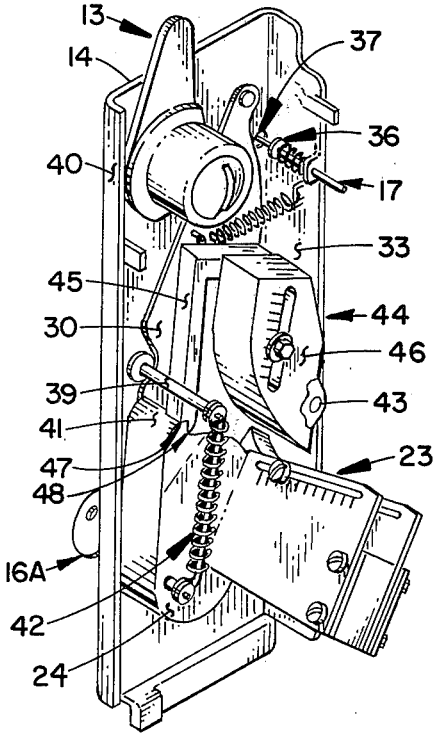
FIG. 3 is a perspective view similar to FIG. 2, but with the lock shown rotated to the stop position.

Referring to FIG. 3, side wall 33 of front plate 14 serves as the rotational mount, at pivot shaft 43, for a coin follower 44, consisting of a stop arm 45 and a follower guide 46. Follower guide 46 may be translationally fixed in relation to stop arm 45, in order to selectively control lock operation, in cooperation with the number and denomination of coins in coin chamber 23. With lock release 17 depressed, door closed, and inadequate or improper coinage in coin chamber 23, a stop tab 47 on stop arm 45 contacts a stop shoulder 48 on support base 24 of coin chamber 23, thereby prohibiting any further rotation of patron key 16A.

Figure 4:
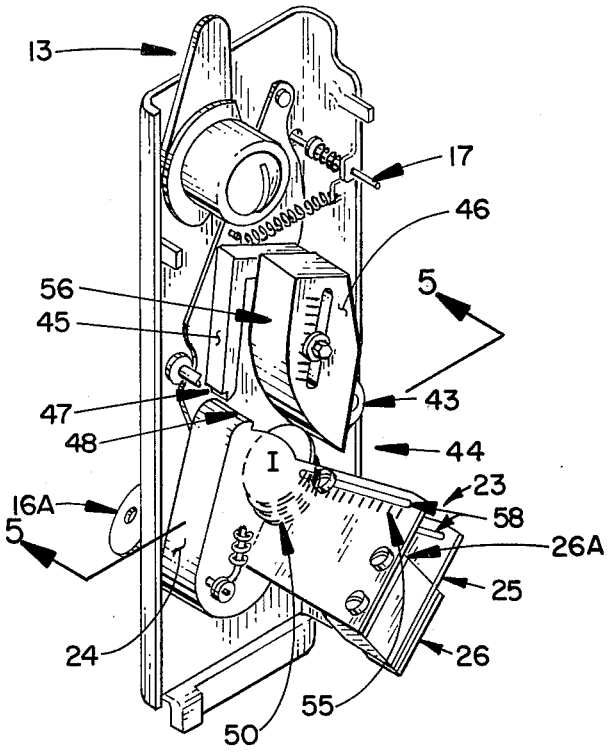
FIG. 4 is a perspective view of the lock mechanism employed in the present invention, with a given denomination of coins in the lock and the lock shown rotated to the point of activation.
Figure 5:
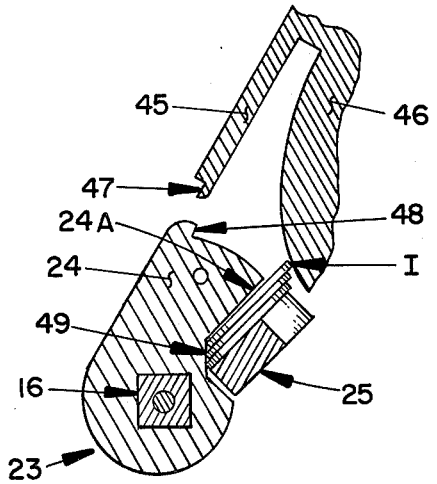
FIG. 5 is a sectional view taken generally along the line 5—5 in FIG. 4.
Figure 6:
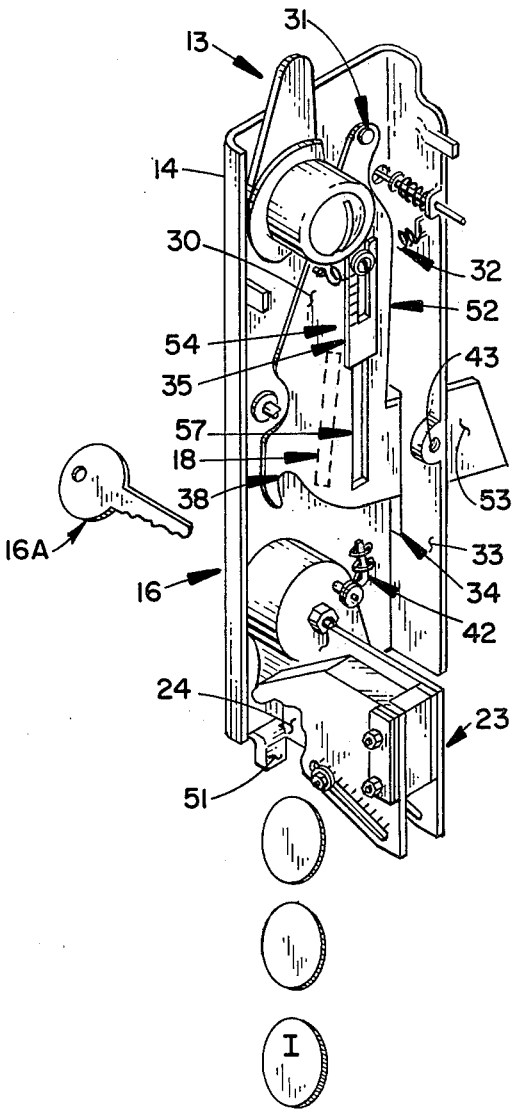
FIG. 6 is a perspective view similar to FIG. 4, but with lock shown in the fully locked position, and coin follower removed for clarity.

Referring now to FIG. 4, lock mechanism 13 has been properly programmed for the desired denomination and number of coins; wherein coin slot guide 35, refer to FIG. 6, has been fixed at that index mark equivalent to the denomination of given coin, depth roller 27 has been fixed in position relative to its denominational index reference, a coded shim 26A of shim set 26 has been selected based upon the width of given coins and such shim has been fixed between the coin support walls of coin chamber 23 and, finally, the follower guide 46 of coin follower 44 has been fixed at its proper index mark as determined by the number and denomination of coins in the coin chamber 23. With door, 11, not shown, fully closed and lock release 17 fully depressed, a final coin I of the given denomination received in coin chamber 23 is the highest coin in the chamber and is that coin which urges follower guide 46 of coin follower 44, thereby camming coin follower 44 clockwise about pivot shaft 43, thus releasing stop tab 47 of stop arm 45 from its interference with stop shoulder 48 of support base 24 and enabling coin chamber 23, and consequently patron key 16A, to be freely rotated. By referring to FIG. 5, which is a sectional view through coin chamber 23 forward of depth roller 27, it will be understood that a ramp 49 sloping downward at an angle of 25 degrees from support base 24 towards coin support wall 25 of coin chamber 23, employed in cooperation with canting the coin chamber 15 degrees clockwise from vertical with the mechanism in the fully unlocked position described in FIG. 2, permits multiple coins to be stacked in coin chamber 23 without fear of interference or jamming of latter deposited coins. This arrangement further insures that only one coin, the last to be deposited, will control the operation of lock mechanism 13.

Referring again to FIG. 2, it will be understood that coin chamber 23 is constructed so that with no shims from shim set 26 employed between support base and wall 24 and coin support wall 25, there exists a coin channel 50, described by coin support elements 24,25 and 27, sufficient to retain the number of given denomination coins intended to operate the lock mechanism, while permitting passage therebetween of coins having a diameter less than the given denomination of coin.

Now referring to FIG. 6, it will be understood that coin chamber 23 under the control of patron key 16A, has been rotated fully clockwise, further motion being prohibited by a coin chamber stop 51, affixed to the rear lower left side surface of front plate 14, abutting up against the inner surface of support base 24 of coin chamber 23. Coin chamber 23 is restrained in its fully clockwise position by the positive force exerted by compression spring and guide 42, allowing patron key 16A to be withdrawn from patron lock 16.

The initial action of coin chamber 23, as it is rotated to the fully locked position, forces locking latch 30 from lock mechanism 13 through the influence of drive pin 28 of support base 24 riding the bottom opening recess 38 of locking latch 30. Once drive pin 28 is released from bottom opening recess 38, locking latch 30 is free to pivot about pivot pin 31, under the influence of latch tension spring 32, to an extended locking position, further motion prevented by a leading edge 52, of locking latch 30, coming into intimate contact with the inner surface of side wall 33 of front plate 14. With lock mechanism 13 in the fully locked position and locking latch 30 fully extended, as evidenced by the maximum protrusion of a latch tongue 53 through elongated slot 34 in side wall 33 of front plate 14, the body of locking latch 30 will completely obscure coin slot 18, thereby preventing coins or other foreign objects from being deposited into the lock, which could render the lock inoperative.

In describing the operation of the present invention, it will first be assumed that lock mechanism 13 has been adjusted to accomodate the lock unit for operation by a grouping of three coins of a given diameter as indicated in FIGS. 4 and 6. To accomplish this, the following adjustments have been performed: coin slot guide 35 has been positioned at an index mark 54, equivalent to the diameter of the given coin, depth roller 27 has been translated along a set of depth adjustment slots 58 to a roller index mark 55, which represents the diameter of the given coin, from shim set 26 a coded shim 26A has been selected which separates coin support wall 25 from support base and wall 24, to provide a coin channel 50, which is equivalent to the total width of the three given coins, and finally, follower guide 46 is positioned at a follower index mark 56, which accomodates for the stackup of the three given coins.

Secondly, it is assumed that lock mechanism 13 is in its unlocked position, as shown in FIG. 2, wherein coin chamber 23 is disposed immediately in front of coin slot 18, with a coin side guiding surface 24A of support base 24 and coin support wall 25 surrounding, and aligned with, the extending side edges of coin slot 18, and no coins have been deposited in coin slot 18. When patron now deposits the first given denomination coin into coin slot 18 of front plate 14, coin passes through a rectangular aperature in locking latch 30, between stop arm 45 and follower guide 46 of coin follower 44 and is stored in coin channel 50 of coin chamber 23, gauged by depth roller 27. Should the deposited coin be of diameter smaller than the given denomination, such coin will not be retained in coin channel 50 by depth roller 27, and will consequently pass freely downward and through the walls of support base 24 and coin support 25 of coin chamber 23 for deposit in the coin collection box, not shown. The free discharge of an improper coin through lock mechanism 13 is not dependent upon the sequence of coin deposit. Uniform blockage of coin channel 50 by depth roller 27 provides release of improper coins until coin channel 50 has received and stored its full complement of given denomination coins. When the patron deposits the final proper denomination, shown in FIG. 4, coin channel 50 of coin chamber 23 will be filled to capacity, thereby permitting the locking sequence to proceed, provided that door 11, not shown, is in the fully closed position. A capacity of coins in the coin channel 50 also prevents any additional coins, either proper or improper, from being deposited into coin slot 18, as a result of blocked entry.

As previously indicated, a full complement of proper denomination coins in coin channel 50 of coin chamber 23, permits operation of lock mechanism 13 by patron key 16A. As may be seen in FIG. 5, the last given denomination coin I to be deposited in coin slot 18, not shown, is established as the highest coin in coin channel 50, as a result of the influence of ramp 49 of support base 24. It is this last coin which operates on follower guide 46 of coin follower 44, resulting in a clockwise rotation of coin follower 44 about pivot shaft 43, whereby stop tab 47 of stop arm 45 is removed as an obstacle in the path of stop shoulder 48 of support base 24 as coin chamber 23 is rotated clockwise from its unlocked position, under the control of patron key 16A. Further, as this rotation takes place, locking latch 30, is released from its stored position by the action of drive pin 28 rotating out of the path of bottom opening recess 38 of locking latch 30, permitting locking latch 30 to extend fully through elongated slot 34 in side wall 33 of front plate 14 under the influence of latch tension spring 32 acting about pivot pin 31. Referring now to FIG. 6, locking latch 30 is controlled in its outward extension by leading edge 52 abutting the inner surface of side wall 33; further, the rear inner wall of elongated slot 34 of side wall 33 provides backup support for locking latch 30, to lessen the possibility of tampering with the locker to gain illegal access. As coin chamber 23 proceeds to its fully locked position, the inner surface of support base 24 comes into contact with coin chamber stop 51 preventing further rotational motion, and all coins are discharged from coin channel 50 into the coin collection box. Coin chamber 23 is retained in this position under the influence of compression spring and guide 42, thereby releasing patron key 16A from patron lock 16. Conversely, when patron key 16A is deployed in patron lock 16 to return lock mechanism 13 to the unlocked condition so that compartment door 11 may be opened, coin chamber 23 and coin follower 44 are returned to their initial operating condition and the sequence of operation herein described may be repeated. It should be noted that a coin diverter cover, not shown, may be disposed over and about the entire operating mechanism, excluding lower discharge end, to preclude the possibility of coins exiting from other overhead locking mechanisms, of the same or similar design, from lodging in lock mechanism 13, thereby effecting a malfunction.

In the present invention, coin chamber 23 and coin follower 44 may be readily adjusted for operation of lock mechanism 13 by varying quantities of given denomination coins, either foreign or domestic, providing the chosen currency has a common circular shape and its exact dimensional characteristics, diameter and thickness, are known.

I claim:

1. A coin operated lock mechanism including a supporting front plate with a vertically sloping aperture for depositing coins, a coin channel normally in communication with said aperture to receive and stack a given complement of deposited coins, a means to provide rotational movement of said coin channel once said coin channel has stored the required complement of coins, a locking latch rotatably supported by said front plate for locking a door in a closed position, wherein said coin channel comprises:

a support base rotatably supported by said rotation means;

a coin support wall adjustably mounted to said support base;

a coded shim set;

a depth roller; and a plurality of mounting hardware.

2. A coin operated lock mechanism as recited in claim 1, wherein said support base comprises:

a coin side guiding surface extending from said support base and aligned with an elongated side of said aperture, said coin channel in the unlocked position;

a coin edge ramp protruding from said coin side guiding surface, supporting said given coin complement and establishing the last given denomination coin to be deposited as the highest or urging coin in said coin channel;

a first depth adjustment slot entending longitudinally along the upper surface of said support base permitting translational movement of said depth roller;

a plurality of roller index marks scribed along said depth adjustment slot;

a drive pin protruding from the underside of said support base acting on said locking latch to urge said latch into a locked or unlocked position; and a stop shoulder formed by a notch along the upper camming surface of said support base trailing said coin side guiding surface.

3. A coin operated lock mechanism as recited in claim 1, wherein a coin support wall is aligned with another elongated side of said aperture, providing down chamber guidance and support for said given coin complement, said coin support wall provided with a second depth adjustment slot adjacent to and parallel with said first depth adjustment slot, said slots permitting translational movement of said depth roller.

4. A coin operated lock mechanism as recited in claim 1, wherein a selected shim from said coded shim set is positioned between said coin side guiding surface and a coin support wall, therinbetween retained by said plurality of mounting hardware, providing a controlled opening in said coin channel equivalent to the combined total width of said given coin complement.

5. A coin operated lock mechanism as recited in claim 1, wherein said depth roller lies with its axis of rotation immediately forward of said aperture providing adjustable placement of said rotational axis along length of said coin chamber within the confines of said depth adjustment slots of said support base and a coin support wall, said depth roller translationally locked by means of said mounting hardware at said roller index mark corresponding to the diameter of said given coin, position of said depth roller providing restraint for given denomination coins and permitting coins smaller in diameter than given coin to pass freely thereinbetween.

6. A coin operated lock mechanism including a supporting front plate apertured for depositing coins, a coin channel normally in communication with said aperture to receive and stack a given complement of deposited coins, a means to provide rotational movement of said coin channel once said coin channel has stored the required complement of coins, a stop arm rotatably mounted on said front plate allowing a narrow coin passage between said aperture and said coin channel for preventing coins from being improperly positioned into said aperture and reducing the possibility of coin jamming.

7. A coin operated lock mechanism including a supporting front plate apertured for depositing coins, a coin channel normally in communication with said aperture to receive and stack a given complement of deposited coins, a means to provide rotational movement of said coin channel once said coin channel has stored the required complement of coins, a stop arm rotatably mounted on said front plate, a follower guide translationally mounted to said stop arm at a given follower index mark, said index mark scribed along the translational axis of said follower guide corresponding to a given coin complement gauging position, said follower guide configured as a beveled triangle along its coin intercepting surface for accomodating varying denominations of coin and massively weighted for providing positive gravitational cooperation with the highest or urging coin.

8. A coin operated lock mechanism including a supporting front plate apertured for depositing coins, a coin channel normally in communication with said aperture to receive and stack a given complement of deposited coins, a means to provide rotational movement of said coin channel once said coin channel has stored the required complement of coins, a locking latch rotatably supported by said front plate for locking a door in a closed position, said locking latch providing moveable mounting for a coin slot guide deployed along the length of a rectangular opening in said locking latch, said opening positioned coincident with said aperture with said coin channel in the fully unlocked position, said coin slot guide translationally positioned at a slot index mark scribed along the extent of said slot guide defining an apertured length equivalent to said given coin diameter.

9. A coin operated lock mechanism including a supporting front plate apertured for depositing coins, a coin channel normally in communication with said aperture to receive and stack a given complement of deposited coins, a means to provide rotational movement of said coin channel once said coin channel has stored the required complement of coins, a locking latch rotatably supported by said front plate for locking a door in a closed position, a motivating means operable by the action of said coin channel for positioning said locking latch between door unlocked and locked positions, wherein said motivating means comprises:

a bottom opening recess in said locking latch rotatably urging said locking latch from said front plate by the forcing action of a drive pin in said bottom opening recess, said drive pin rotated under influence of the rotation means; and a latch tension spring deployed between said front plate and said locking latch allowing the locking latch to be fully extended in the locked position as said drive pin is withdrawn from said bottom opening recess.

* * * * *